United States Patent [19]

Osborne

[11] Patent Number: 4,897,951

[45] Date of Patent: Feb. 6, 1990

[54] FIREARM SAFETY

[75] Inventor: William E. Osborne, Guilford, Conn.

[73] Assignee: The Marlin Firearms Company, North Haven, Conn.

[21] Appl. No.: 261,621

[22] Filed: Oct. 24, 1988

[51] Int. Cl.[4] ..... F41C 17/02

[52] U.S. Cl. ..... 42/70.06; 42/69.02

[58] Field of Search ..... 42/69.02, 70.06

[56] References Cited

U.S. PATENT DOCUMENTS 2,282,842 9/1949 Crockett .
2,551,166 5/1951 Roemer et al. .
2,565,688 8/1951 Horan .
2,765,562 10/1956 Roper et al. .
3,234,679 2/1966 Benson .
3,713,242 1/1973 Seifried .
4,300,301 11/1981 Morrison .

*Primary Examiner*—Charles T. Jordan
*Assistant Examiner*—Richard W. Wendtland
*Attorney, Agent, or Firm*—Chilton, Alix & Van Kirk

[57] ABSTRACT

A firearm safety for a firearm comprises a bracket mounted at the underside of the receiver. The bracket defines a pair of recesses for receiving detent shoulders of an operator arm. The bracket is spring-biased to permit the operator arm to be manually pivoted in snap-type fashion into one of the two recesses. The operator arm engages the trigger in one pivotal position to prevent actuation of the trigger.

20 Claims, 4 Drawing Sheets

FIREARM SAFETY

BACKGROUND OF THE INVENTION

This invention relates generally to safety mechanisms employed in firearms to prevent accidental firing of the firearm. More particularly, this invention relates to manually actuatable safety mechanisms which directly interact with the trigger to prevent firing of the firearm.

A wide variety of safety mechanisms have been advanced for preventing the accidental firing of a firearm. For example, W. F. Roper et al U.S. Pat. No. 2,765,562 discloses a safety mechanism for a bolt-action firearm wherein a pivoted locking member is engagable in a notch of the trigger to prevent pulling of the trigger. The locking member is actuated by a reciprocating slide in the side of the receiver. C. H. Benson U.S. Pat. No. 3,234,679 discloses a thumb operated safety for a bolt-action firearm The safety moves with the bolt as the bolt is retracted to the open position. The safety is placed out of operative relationship with the trigger member when the bolt is not locked, but a secondary safety device positively locks the striker in cocked position while the bolt is unlocked.

Morrison U.S. Pat. No. 4,300,301 discloses a safety assembly which is mounted in a lateral bore through the trigger guard cage and rearwardly of the pivoted trigger A rotatable barrel-like member blocks rearward trigger motion in one detent position and permits the trigger to move in a second detent position wherein a cavity of the barrel mates with a trigger extension finger and allows the trigger to pivot. A rotating lever is positioned for actuation of the safety by a middle finger with the trigger finger in place.

In another conventional firearm safety, a lever-like arm is pivotally mounted to the trigger support. The safety has a spring-loaded handle which is pivotal between a fire and a safety position. The opposing end of the safety has a catch engagable with a lug which transversely projects from the trigger. In one pivotal position, the catch engages the lug to prevent firing of the trigger. In a second pivotal position, the catch disengages from the lug to permit firing of the firearm.

SUMMARY OF THE INVENTION

Briefly stated, the invention in a preferred form is a safety for a firearm of a type having a receiver and a trigger which is pivotally mounted to a support member located at the underside of the receiver. A bracket is mounted to the support member for restricted pivotal movement thereabout and is biased toward the underside of the receiver The bracket further defines first and second recesses A lever-like operator arm is retainably captured between the bracket and the receiver. The operator arm has an engagement portion for pivotal engagement at the underside of the receiver and a generally opposing locking dog. The operator arm also comprises a handle for manually pivoting the arm. The operator arm further forms an intermediate detent which is pivotally engagable in the recesses. A trigger catch is engagable by the locking dog to prevent pivotal movement of the trigger. When the operator arm is in the safety pivotal position, the locking dog engages the trigger catch and the operator arm detent is retainably engaged in the first recess. As the operator arm is pivotally moveable from the safety to the fire pivotal position, the bracket pivots to permit the detent to rock into engagement in the second recess whereby the locking dog disengages from the trigger catch.

The bracket preferably further comprises a pair of laterally-spaced side members, each of which define first and second recesses for the operator arm detent. The detent may be formed by a pair of intermediate transversely projecting shoulders of the operator arm. A spring is coiled around a pivot pin which mounts the bracket to the support member. The bracket further has an enlarged opening. A pin extends through the opening to mount the trigger. The opening is sufficiently larger than the pin to permit pivotal movement of the bracket. One end of the spring engages the pivot pin, and the other end of the spring engages the underside of the bracket to pivotally bias the bracket. An end portion of the operator arm is slidably receivable in a transverse slot formed in the receiver. The operator arm also includes a lug which is receivable in the guide slot of the receiver to transversely retain the operator arm to the receiver.

An object of the invention is to provide a new and improved firearm safety for preventing the accidental firing of a firearm.

Another object of the invention is to provide a new and improved firearm safety having an efficient construction and which may be assembled in an efficient and low cost manner.

A further object of the invention is to provide a new and improved firearm safety having a positive snap-type detent engagement which locks the trigger in the safety position and is biased to maintain the safety position until manually released.

Other objects and advantages of the invention will become apparent from the drawings and the specification.

DETAILED DESCRIPTION OF THE INVENTION

Figure 1:
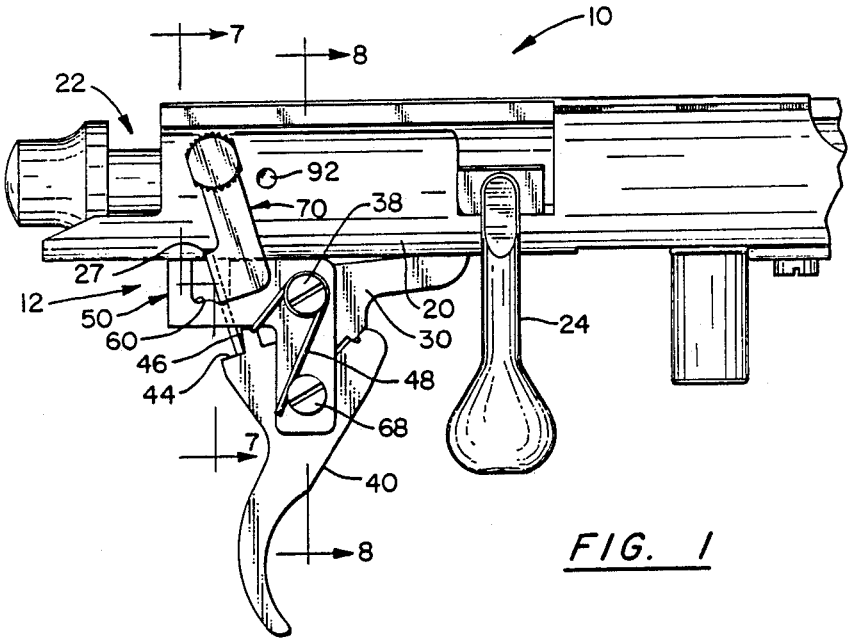
FIG. 1 is a fragmentary side view, partly broken away and partly in phantom, of a firearm illustrating a firearm safety in accordance with the present invention, said firearm safety being depicted in the safety position.

With reference to the drawings wherein like numerals represent like parts throughout the several figures, a firearm 10 (partially illustrated) incorporates a firearm safety assembly designated generally by the numeral 12. In accordance with the invention, the firearm safety assembly 12 has application with numerous types and makes of firearms The partially illustrated firearm 10 is a bolt-action firearm which is illustrated for purposes of describing the invention. The specific depicted firearm 10 should not be deemed a limitation of the firearm safety assembly 12 nor its application.

Firearm 10 includes a receiver 20 which receives a longitudinally retractable bolt assembly 22. A bolt handle 24 projects in offset relationship to th bolt assembly for manually retracting and locking the bolt for loading and unloading the firearm in a conventional manner which will not be described in detail. The bolt assembly includes a spring-loaded firing pin (not illustrated) which is released through a sear 30 by means of manual actuation of a trigger 40 in a conventional fashion. The underside of the receiver further includes a conventional longitudinal bolt guide slot 25 and a narrow transverse slot 27 which is formed for the safety assembly 12.

Figure 3:
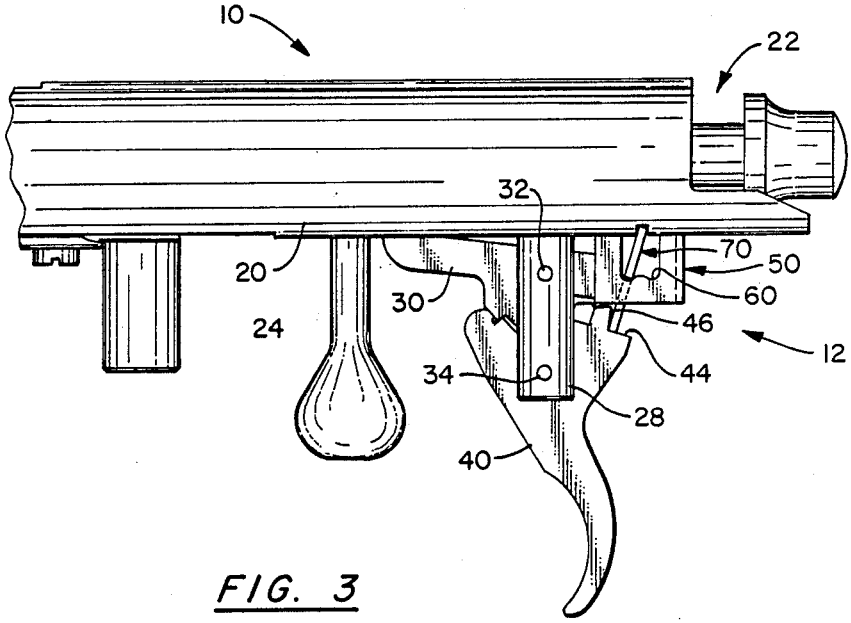
FIG. 3 is a fragmentary side view, partly broken away and partly in phantom, of the firearm and the firearm safety of FIG. 1 viewed from the opposite side thereof.
Figure 4:
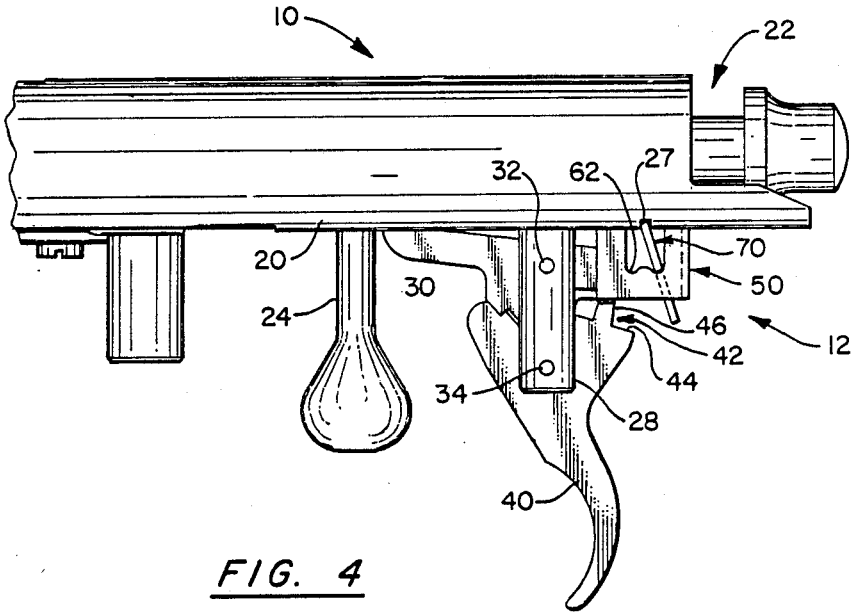
FIG. 4 is a fragmentary side view, partly broken away and partly in phantom, of the firearm and firearm safety of FIG. 2 viewed from the opposite side thereof.
Figure 8:
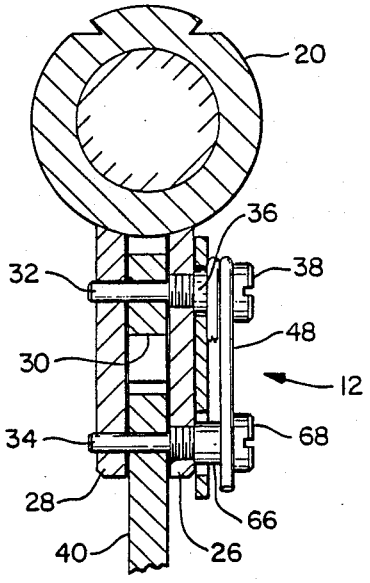
FIG. 8 is a sectional view of the firearm and the firearm safety of FIG. 1 taken along the line 8—8 thereof.

With reference to FIGS. 3, 4, and 8, a pair of studs 26 and 28 integrally project downwardly from the underside of the receiver 20. The studs 26 and 28 define an intermediate slot for receiving the sear 30 and the trigger 40 and their associated components. The studs 26 and 28 form a support structure for pivotally mounting the sear 30 and the trigger 40. Cross pins 32 and 34 are threadably secured in the studs to pivotally mount the respective sear and trigger as will be described in detail below. It will be appreciated that pivotal movement of the trigger in the clockwise direction of FIG. 1, releases the sear for clockwise pivoting to fire the firearm in a conventional manner which will not be described in detail.

An upper rear portion of the trigger 40 has a notch 42 defined by a pair of intersecting cooperative shoulders 44 and 46. Except for the described notch 42, trigger 40 is essentially conventional in form and function. The trigger guard and other conventional components of the firearm are not depicted in the drawings.

Figure 5:
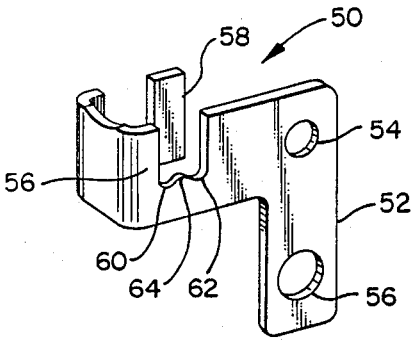
FIG. 5 is a perspective view of a bracket employed in the firearm safety of FIG. 1.

A bracket 50 (best illustrated in FIG. 5) is pivotally mounted to stud 26 by means of cross pin 32 which is threaded to the stud 26. Cross pin 32 comprises an outer screwhead 38 and an intermediate stud portion which receives a spring clip 48 (as best illustrated in FIG. 8). Bracket 50 comprises a front mounting plate 52 which defines the opening 54 for the pivot pin 32 and an enlarged opening 56 which accommodates cross pin 34. Bracket 50 extends rearwardly and is bent to form a pair of transversely spaced sides 56 and 58. Each of the sides forms a slot having a lower boundary which is defined by cooperative scallop-like recesses 60 and 62. The recesses 60 and 62 which function as catches are separated by a cam-like hump 64.

Figure 6:
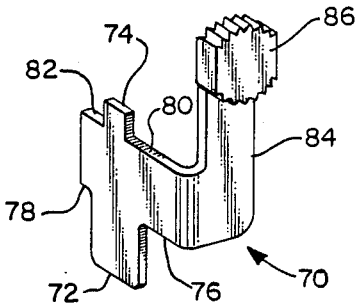
FIG. 6 is a perspective view of an operator arm employed in the firearm safety of FIG. 1.
Figure 7:
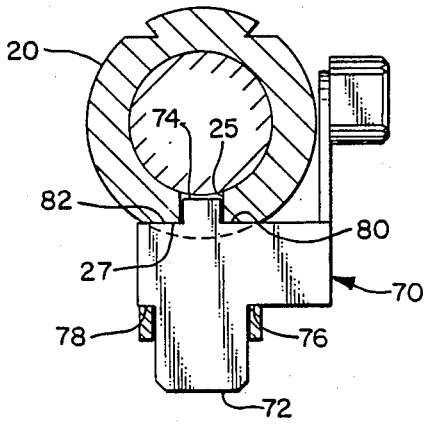
FIG. 7 is a sectional view of the firearm and the firearm safety of FIG. 1 taken along the line 7—7 thereof.

A lever-like operator arm 70 (FIG. 6) is captured in the spaced slots defined in the bracket sides 56 and 58 at the underside of the receiver The operator arm has a planar portion comprising a tongue-like locking dog 72 at the bottom portion thereof and a pivot lug 74 at the top portion thereof. Intermediate transversely projecting shoulders 76 and 78 of the operator arm engagably interact with the edge defining portions of the recesses 60 and 62, as will be detailed below. The interaction between the shoulders and the bracket supports the operator arm so that the tongue-like locking dog 7 extends downwardly and projects through the underside rear portion of the bracket in a quasi-suspended manner. The pivot lug 74 is received in the longitudinal guide slot 25 of the bolt assembly for transversely locating the operator arm 70. The top of the operator arm also forms projecting transversely spaced shoulders 80 and 82. The upper shoulders 80 and 82 engage in the transverse slot 27 which extends transversely across the underside of the receiver to form a loose fitting pivotal engagement against the receiver.

An actuator arm 84 extends generally upwardly and forwardly at a right angle to the planar locking portion of the operator arm 70. A serrated knob 86 is mounted at an upper outer portion of the actuator arm to facilitate manual pivotal movement of the actuator arm and thus the operator arm. A pair of indentations 90 and 92 are formed at the side of the receiver and are alignable with selected pivotal positions of the actuator arm to provide a visual indication of the respective active safety and inactive fire positions of the safety.

The spring clip 48 is coiled around cross pin 32 and secured by screwhead 38. One end of the spring clip 48 engages against a rear portion of pin 34. The opposite end of the spring 48 is bent into spring-loaded engagement at the underside of the mounted bracket 50 to pivotally bias the bracket toward the underside of the receiver Pin 34 has a distal end extending through trigger 40 and stud 28, a threaded portion, and an intermediate stud head 66 which threadably tightens to stud 26. The cross pin 34 also includes an integral screwhead 68. The diameter of the enlarged opening 56 of the bracket is sufficiently larger than the diameter of the stud head 66 to allow a limited pivoting of the bracket 50 about the upper cross pin 32 which also mounts the spring 48.

In the active safety mode illustrated in FIG. 1, the end of the locking dog 72 engages the shoulders of the trigger notch 42 to prevent the clockwise pivoting of the trigger (rearward movement) to thereby prevent firing of the firearm. The shoulders 76 and 78 of the operator arm retainably forcibly engage the edges of the recesses 60 of the bracket. The spring biasing of the bracket by spring clip 48 urges the shoulders to be retained in the spaced recesses 60 to thereby define a safety stable position of the operator arm 70.

Figure 2:
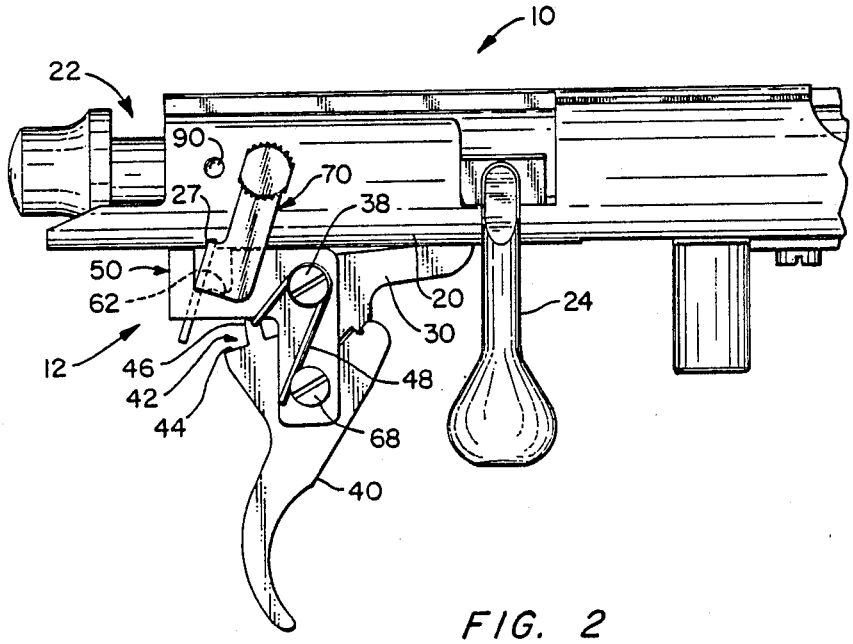
FIG. 2 is a fragmentary side view, partly broken away and partly in phantom, of the firearm and the firearm safety of FIG. 1, said firearm safety being depicted in the firing position.

The operator arm 70 is manually actuatable to the inactive fire position of FIG. 2 by pivotally moving the actuator arm 84 clockwise as viewed in FIGS. 1 and 2. The pivotal movement toward the fire position causes the shoulders 76 and 78 to ride or cam over the spaced humps 64 and into the forward recesses 62 wherein the spring bias of the bracket returns the bracket into a snap-type positive engagement capturing the operator arm between the bracket and the receiver in the fire position, as best illustrated in FIGS. 2 and 4.

In the fire position, the locking dog 72 is disengaged from the trigger notch 42. The trigger is free to be fired (pulled rearwardly). It should be appreciated that the actuator arm 70 is essentially freely pivotal relative to the receiver. The floating pivot between the actuator arm and the bracket allows for the actuator arm to pivotally move in a rocking-type fashion from the fire position to the safety position and from the safety position to the fire position in a very positive snap fit-type transformation. Each position is firmly maintained until the actuator arm is pivoted to the other position. The safety and fire positions are essentially depicted visually by the alignment of the actuator arm knob 86 with the corresponding respective indentations 90 and 92 on the side of the receiver.

Figure 9:
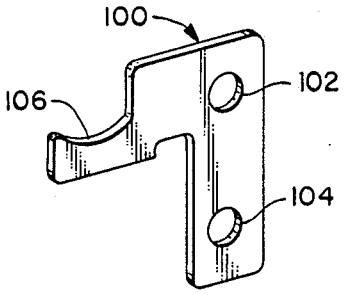
FIG. 9 is a perspective view of a safety plate which may be employed in one embodiment of the firearm safety in accordance with the present invention.
Figure 10:
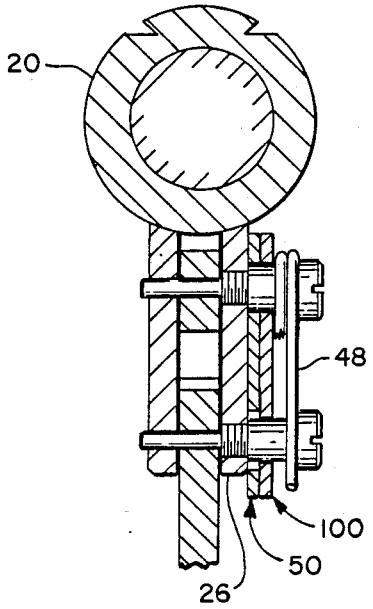
FIG. 10 is a sectional view of a firearm and firearm safety employing the safety plate of FIG. 9.

With additional reference to FIGS. 9 and 10, a safety plate 90 may be mounted between the safety bracket 50 and the spring clip 48. The retaining pins 32 and 34 are dimensioned to accommodate the safety plate 100. The safety plate includes openings 102 and 104 which receive the retaining pins so as to mount the safety plate in fixed relationship with studs 26 and 28. The safety plate defines a cam-like surface 106, which engages the safety lever 70 and prevents the safety lever from being downwardly forced to a position which binds the lever and intervenes with the proper operation of the safety. It will be appreciated that while the bracket pivots to permit the detent to rock into engagement with one of the recesses, the safety plate essentially maintains a fixed relationship with the firearm.

The described firearm safety 12 may be assembled in an efficient manner wherein manufacturing tolerances of the bracket 50 and the operator arm 70 may be relatively easily achieved so that no or little adjustment is required during assembly to provide for proper operation of the safety. The spring loading of the bracket and the resulting quasi-floating pivot-type configuration provides both a positive snap-in detent action for the safety as well as a mechanism to retain the operator arm within the safety assembly. The positive spring biased detent action functions to confirm that the selected safety or fire position has been obtained and also to reliably maintain the safety position until the safety has been manually pivotally released for firing.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. A safety for a firearm having a receiver and a trigger pivotally mounted at the underside of the receiver comprising:

bracket means pivotally mounted at the underside of the receiver for restricted pivotal movement, said bracket means defining first and second recesses;

biasing means for pivotally biasing said bracket means in a first pivotal direction;

operator arm means captured between said bracket means and receiver, said operator arm means having an engagement portion for pivotal engagement at the underside of said receiver and a generally opposing locking dog, said operator arm means comprising handle means for manually pivoting said operator arm means and detent means for pivotal engagement in said recesses; and trigger catch means for engagement by said locking dog to prevent pivotal movement of the trigger;

so that when said operator arm means is in a safety pivotal position, the locking dog engages the trigger catch means and the detent means is retainably engaged in said first recess and said operator arm means is pivotally moveable to a fire pivotal position wherein said bracket means pivots to permit said detent means to rock into engagement into said second recess whereby said locking dog disengages said trigger catch means.

2. The firearm safety of claim 1 wherein said bracket means further comprises a pair of laterally-spaced side members each defining said first and second recesses.

3. The firearm safety of claim 2 wherein said detent means further comprises a pair of transversely projecting shoulders.

4. The firearm safety of claim 1 further comprising a pivot pin for pivotally mounting said bracket means and wherein said biasing means further comprises a spring which is coiled around said pivot pin.

5. The firearm safety of claim 4 wherein said bracket means further defines an enlarged opening and further comprising a second pin extending through said opening to mount said trigger, said opening being sufficiently larger than the diameter of the portion of the second pin in said opening to permit restrictive pivotal movement of said bracket means.

6. The firearm safety of claim 5 wherein said spring is a clip having two ends and one end of the spring engages second pivot pin and the other end of the spring engages the underside of the bracket means to pivotally bias said bracket means.

7. The firearm safety of claim 1 wherein said receiver means further comprises means defining a transverse slot and said operator arm means engagement portion is slidably receivable in said transverse slot.

8. The firearm safety of claim 1 wherein said receiver further defines a longitudinally extending guide slot and said operator arm means further comprises a lug which is receivable in said guide slot to transversely retain the operator arm means to the receiver.

9. The firearm safety of claim 1 wherein said trigger catch means comprises means defining a notch in said trigger.

10. A safety for a firearm having a receiver and a trigger pivotally mounted at the underside of the receiver to a mounting structure comprising:

bracket means mounted to said mounting structure for restricted pivotal movement thereabout, said bracket means defining first and second recesses;

biasing means for pivotally biasing said bracket means in a first pivotal direction;

operator arm means captured between said bracket means and receiver, said operator arm means having an engagement portion for pivotal engagement at the underside of said receiver and a generally lower locking dog, said operator arm means comprising generally upwardly extending handle means for manually pivoting said operator arm means and detent means intermediate said engagement portion and locking dog for pivotal engagement in said recesses; and trigger catch means defining a notch in said trigger for engagement by said locking dog to prevent pivotal movement of the trigger;

so that when said operator arm means is in a safety pivotal position, the locking dog engages the trigger catch means and the detent means is retainably engaged in said first recess and said operator arm means is pivotally moveable to a fire pivotal position wherein said bracket means pivots against the bias of said biasing means to permit said detent means to rock into engagement into said second recess whereby said locking dog disengages said trigger catch means.

11. The firearm safety of claim 10 wherein said bracket means further comprises a pair of laterally-spaced side members each defining generally scallop-shaped first and second recesses.

12. The firearm safety of claim 11 wherein said detent means further comprises a pair of transversely projecting shoulders.

13. The firearm safety of claim 10 further comprising a pivot pin for pivotally mounting said bracket means and wherein said biasing means comprises a spring which is coiled around said pivot pin.

14. The firearm safety of claim 13 wherein said bracket means further defines an enlarged opening and further comprising a second pin extending through said opening to mount said trigger, said opening being sufficiently larger than the diameter of the portion of the second pin in said opening to permit restricted pivotal movement of said bracket means.

15. The firearm safety of claim 14 wherein said spring is a clip having two ends and one end of the spring engages said second pin and the other end of the spring engages the underside of the bracket means to pivotally bias said bracket means.

16. A safety for a firearm having a receiver and a trigger and a sear each pivotally mounted to a support member located at the underside of the receiver comprising:

bracket means mounted to said support member for restricted pivotal movement about the pivotal axis of the sear, said bracket means defining first and second recesses;

operator arm means retainably captured between said bracket means and receiver, said operator arm means having an engagement portion for pivotal engagement at the underside of said receiver and a generally opposing lower locking dog, said operator arm means comprising generally upwardly extending handle means for manually pivoting said operator arm means and transversely projecting detent means intermediate said engagement portion and locking dog for pivotal engagement in said recesses;

biasing means for pivotally biasing said bracket means in a first pivotal direction for engagably capturing said operator arm means in releasably fixed pivotal positions between said bracket means and said receiver; and trigger catch means defining a notch in said trigger for engagement by said locking dog to prevent pivotal movement of the trigger;

so that when said operator arm means is in a safety pivotal position, the locking dog engages the trigger catch means and the detent means is retainably engaged in said first recess and said operator arm means is pivotally moveable to a fire pivotal position wherein said bracket means pivots against the bias of said biasing means to permit said detent means to rock into engagement into said second recess whereby said locking dog disengages said trigger catch means.

17. The firearm safety of claim 15 wherein said biasing means further comprising a spring which is coiled around said pivot pin.

18. The firearm safety of claim 16 wherein said bracket means further defines an enlarged opening and further comprising a second pin extending through said opening to mount said trigger, said opening being sufficiently larger than the diameter of the portion of the second pin in s id opening to permit restricted pivotal movement of said bracket means.

19. The firearm safety of claim 17 wherein said spring is a clip having two ends and one end of the spring engages said second pin and the other end of the spring engages the underside of the bracket means to pivotally bias said bracket means.

20. The firearm safety of claim 16 further comprising a safety plate mounted in fixed relationship to said support member, said safety plate having an engagement surface which is engagable with said operator arm means to prevent said operator arm means from binding engagement with said bracket means.

* * * * *